United States Patent [19]

Bruguera

[11] 4,138,204

[45] Feb. 6, 1979

[54] GEAR PUMP

[75] Inventor: Raimundo S. Bruguera, Barcelona, Spain

[73] Assignee: Bendiberica S.A., Spain

[21] Appl. No.: 766,315

[22] Filed: Feb. 7, 1977

[30] Foreign Application Priority Data

Feb. 10, 1976 [ES] Spain ..... 445.021

[51] Int. Cl.[2] ..... F04B 49/10

[52] U.S. Cl. ..... 417/300; 417/310; 417/440

[58] Field of Search ..... 417/307, 308, 310, 440, 417/300

[56] References Cited

U.S. PATENT DOCUMENTS

| | | | |
|---|---|---|---|
| 3,120,814 | 2/1964 | Mueller | 417/310 |
| 3,153,508 | 10/1964 | Sawyer | 417/300 X |
| 3,322,134 | 5/1967 | Enemark | 417/310 X |
| 3,427,980 | 2/1969 | Jubb et al. | 417/310 X |
| 3,527,548 | 9/1970 | Kocher et al. | 417/310 |
| 3,568,435 | 3/1971 | May | 417/300 X |
| 3,667,859 | 6/1972 | Dragsund et al. | 417/310 X |
| 3,751,190 | 8/1973 | Cecchi | 417/310 X |
| 3,813,187 | 5/1974 | Winter | 417/310 X |
| 3,957,075 | 5/1976 | Kunz et al. | 417/300 X |

*Primary Examiner*—John J. Vrablik
*Assistant Examiner*—Edward Look
*Attorney, Agent, or Firm*—Paul David Schoenle; Ken C. Decker

[57] ABSTRACT

A gear pump which comprises a casing provided with an inlet port communicating with an intake chamber, and a delivering port communicating with a delivery chamber. A drive gear is mounted in meshing engagement with a driven gear, each gear being placed in a corresponding bore in the casing, the gears being placed in the flow path between the intake chamber and the delivering chamber.

One of the gears contains a central bore with passages which connect the bore to the gaps between adjacent teeth of the gear. A spool is slidable in the central bore for controlling fluid communication through the passages and the movements of the spool are controlled by the pressure difference between the fluid pressure in the delivery chamber and an operating pressure in such a way that the spool is held in a closure position in which the communication through the passages remains blocked as long as the delivery of the pump remains below a given level corresponding to a predetermined pressure difference.

1 Claim, 3 Drawing Figures

GEAR PUMP

The invention relates to a hydraulic pump of the gear type.

A gear pump generally comprises a casing, provided with an inlet port communicating with an intake chamber and a delivery port communicating with a delivery chamber, and a drive gear which is controlled by an electric motor and which meshes with a driven gear. The two gears are installed in respective bores in the casing and are in the flow path between the inlet and delivery ports. Fluid flows from the intake chamber to the delivery chamber through the gaps between the longitudinal surfaces of the bores and the teeth of their respective gears.

In general the delivery of a gear pump of the type described is proportional to the speed of the pump, that is, to the rotational speed of the drive gear. Where it is desirable to obtain a delivery of substantially constant value independent of the pump speed, the pump must have means for regulating its flow rate.

An object of the invention is to propose a gear pump whose delivery is regulated to a substantially constant value independent of the pump speed.

The invention consists of a gear pump of the type comprising a casing provided with an inlet port communicating with an intake chamber and a delivery port communicating with a delivery chamber, a drive gear meshing with a driven gear, each gear being installed in a corresponding bore in the casing, the gears being placed in the flow path between the intake chamber and the delivery chamber, one of the gears comprising a central bore to which lead passages connecting the bore to the gaps between the adjacent teeth of the gear, a spool being slidable in the central bore, the movements of the spool being controlled by the pressure difference between the fluid pressure in the delivery chamber and an operating pressure in such a way that the spool is held in a closed position in which the route through the passages remains blocked as long as the delivery of the pump remains below a given level corresponding to a predetermined pressure difference.

According to another feature of the invention, the spool comprises two bearing surfaces defining with the central bore two end chambers and a central chamber, the end chambers being exposed respectively to the fluid pressure in the delivery chamber and to the operating pressure, the route through the passages being blocked by one bearing surface of the spool when the latter is in its closed position, and the said route being open when the central chamber is opposite the passages due to movement of the spool.

The invention will now be described by way of example with reference to the accompanying drawings, in which.

Figure 1:
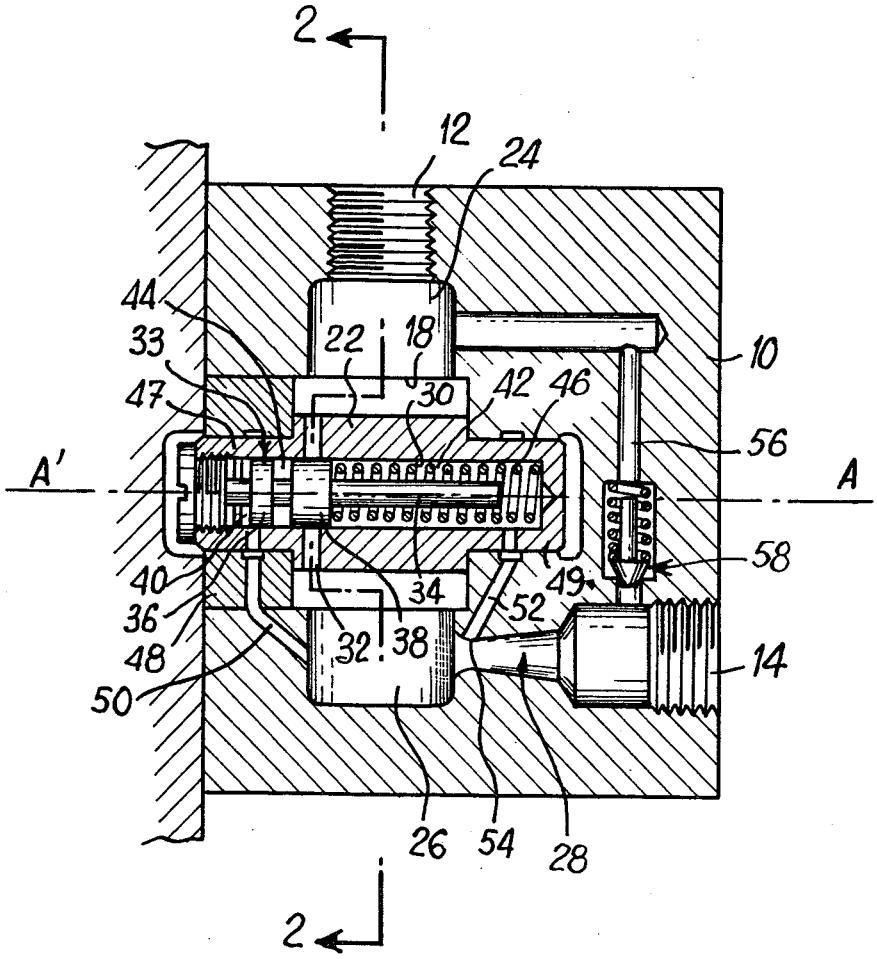
FIG. 1 represents a section through a gear pump embodying the invention.
Figure 2:
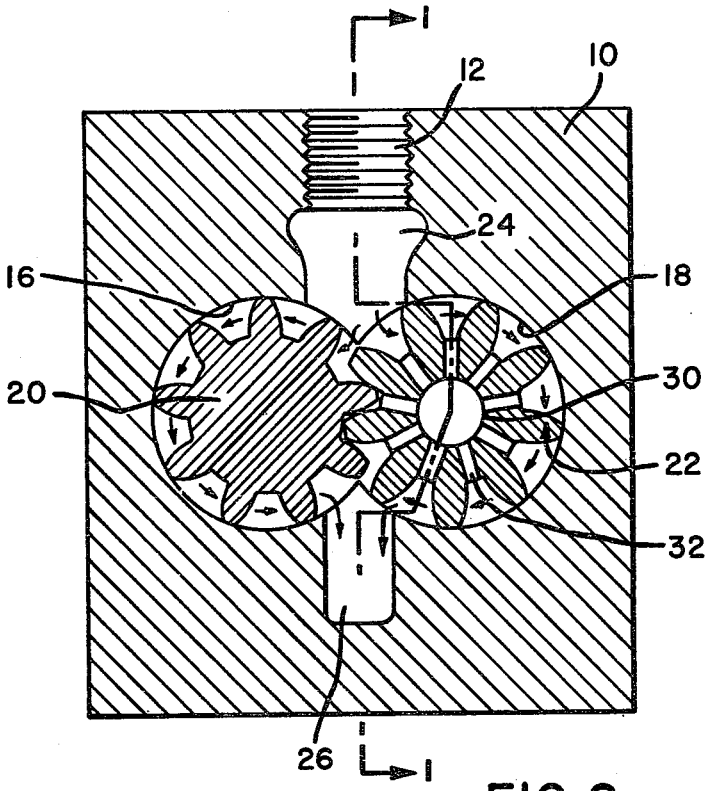
FIG. 2 is a section along a line 2—2 in FIG. 1.

In the drawings a casing 10 comprises an inlet port 12 and a delivery port 14. The casing contains two bores 16, 18 of identical diameters, with mutually parallel axes perpendicular to the axis of the inlet port. The two bores 16, 18 partly overlap. Inside the bores there are respective gears 20, 22 with identically shaped teeth which mesh in the space defined by the overlap between the two bores 16, 18. This space communicates with the inlet port 12 by way of an intake chamber 24 and with the delivery port 14 by way of a delivery chamber 26. The gear 20 is rotated by a motor (not shown) and is termed the drive gear. It rotates the gear 22, which is termed the driven gear. FIG. 1, which is a section along a line 1—1 in FIG. 2, shows that the delivery chamber 26 is connected to the delivery port by way of a venturi 28.

A bore 30 is formed in the driven gear 22. The bore 30 is coaxial with the bore 18 and with the gear 22. The gear 22 contains radial passages 32 which are equispaced round the axis of the bore 30 in a plane perpendicular to the latter, and which enable the bore 30 to communicate with the bore 18 and therefore with the chambers 24, 26. The passages 32 connect the central bore 30 to the gaps between the adjacent teeth of the gear 22. A spool generally designated 33 is slidable in the bore 30. The spool has a central rod 34 which runs along the axis of the bore 30, and on which there are two bearing surfaces 36, 38 which, with the bore 30, define first and second end chambers 40, 42 and a central chamber 44. A spring 46 situated in the chamber 42 urges the spool 33 to the left in FIG. 1. When the spool is in the idle position, the spring 46 biases it so that the bearing surface 38 blocks the radial passages 32, with the result that the bores 18, 30 do not communicate.

The driven gear 22 has journals 47, 49 which rotate respectively in a bearing 48 and in the casing. A passage 50 formed in the casing 10, in the bearing 48 and in the journal 47 of the driven gear 22 connect the first end chamber 40 to the delivery chamber 26. Similarly, a passage 52 formed in the casing 10 and in the journal 49 of the gear 22 connects the neck 54 of the venturi 28 to the end chamber 42. A further passage 56, containing an excess pressure valve 58, connects the delivery port 14 to the chamber 24.

The apparatus just described operates as follows.

The drive gear 20 rotates the driven gear 22. Fluid is thus trapped between the walls of the bores 16, 18 and the teeth of the respective pinions 20, 22 and flows from the intake chamber to the delivery chamber as indicated by solid arrows in FIG. 2. The close engagement of the meshing gear teeth prevents the fluid from returning to the intake chamber. Pressure is then generated in the delivery chamber, on account of the resistance due to the venturi 28. This pressure is transmitted to the first end chamber 40 and is exerted on the spool 33, counteracting the spring 46. Similarly, the pressure in the neck 54 of the venturi 28 is transmitted to the end chamber 42 by way of the passage 52. The pressure obtained in the neck 54 of the venturi 28 is the lower pressure prevailing between the delivery chamber 26 and the delivery port 14. This pressure is termed the operating pressure. Also, the operating pressure is a function of the flow rate in the venturi.

When the flow rate of the pump is below its rated value, the pressures in the end chambers 40, 42 are such that the pressure difference between the two chambers is too small to overcome the force of the spring 46. The spool remains in its idle position. The route through the radial passages 32 is now blocked.

When the flow rate becomes equal to or greater than its rated value, the pressure difference between the chambers 40, 42 is sufficient to overcome the force of the spring 46. The spool 33 is then moved to the right in FIG. 1, possibly into its limit position. Fluid can now flow through the radial passages 32, producing a transfer of fluid from the delivery chamber to the intake chamber.

In response to an increase in the flow rate, therefore, the pressure difference between the end chambers 40, 42 varies to cause excess fluid to return by way of the central chamber 44 and passages 32, so giving a constant flow rate at the delivery port.

Figure 3:
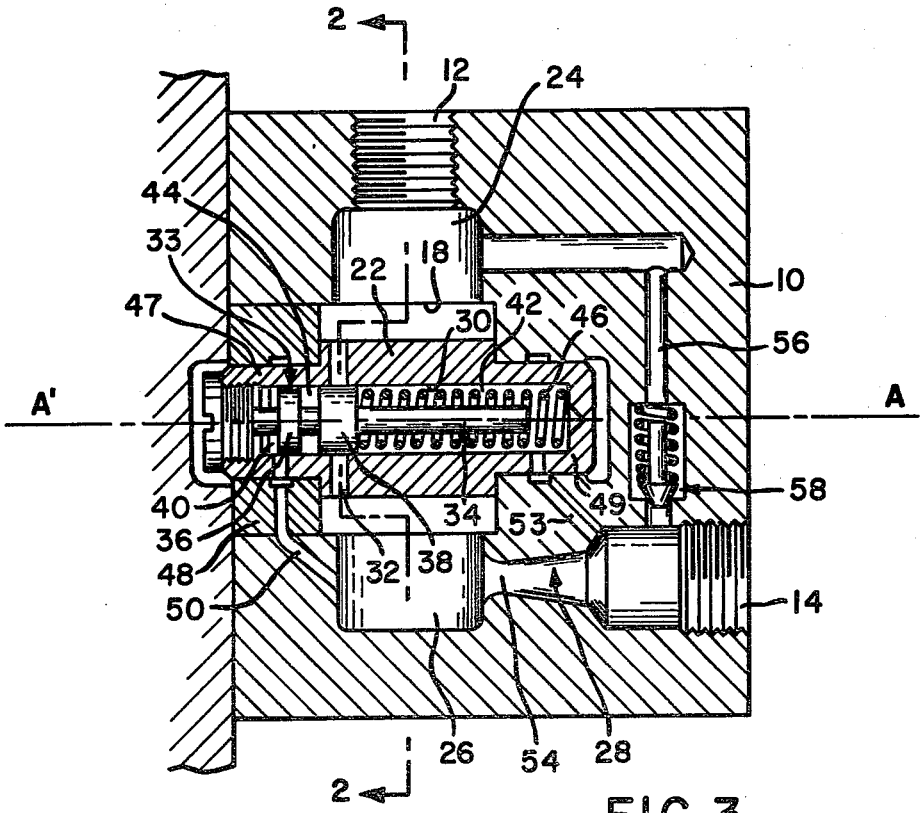
FIG. 3 is a view similar to FIG. 2 and showing a variant of the invention.

In a variant of the embodiment which has just been described, the passage 52 is omitted and replaced by a passage 53, see FIG. 3, in the casing connecting the end chamber 42 to the delivery port. The apparatus is less sensitive to variations in the flow rate, but still functions satisfactorily since it also is operated by a pressure difference representing the speed of the motor.

I claim:

1. A gear pump comprising a casing provided with an inlet port communicating with an intake chamber and a delivery port communicating with a delivery chamber, a drive gear meshing with a driven gear, each gear being placed in a corresponding bore in the casing, the gears being placed in the flow path between the intake chamber and the delivery chamber, characterized in that one of the gears contains a central bore to which lead passages connecting the bore to the gaps between the adjacent teeth of the gear, a spool being slidable in the central bore, the movements of the spool being controlled by the pressure difference between the fluid pressure in the delivery chamber and an operating pressure in such a way that the spool is held in a closed position in which the route through the passages remains blocked as long as the delivery of the pump remains below a given level corresponding to a predetermined pressure difference, the spool comprising two bearing surfaces defining with the central bore two end chambers and a central chamber, the end chambers being exposed respectively to the fluid pressure in the delivery chamber and to the operating pressure, the route through the passages being blocked by one bearing surface of the spool when the latter is in its closed position, and the said route being open when the central chamber is opposite the passages due to movement of the spool.

* * * * *